United States Patent [19]

Sawaragi

[11] Patent Number: 4,892,704

[45] Date of Patent: Jan. 9, 1990

[54] LOW SI HIGH-TEMPERATURE STRENGTH STEEL TUBE WITH IMPROVED DUCTILITY AND TOUGHNESS

[75] Inventor: Yoshiatsu Sawaragi, Nishinomiya, Japan

[73] Assignee: Sumitomo Metal Industries, Ltd., Osaka, Japan

[21] Appl. No.: 232,636

[22] Filed: Aug. 8, 1988

[30] Foreign Application Priority Data

Apr. 28, 1988 [JP] Japan ..... 63-106794

[51] Int. Cl.[4] ..... C22C 38/48

[52] U.S. Cl. ..... 420/59; 420/48; 420/56; 420/584; 148/327; 148/909; 148/442; 138/177

[58] Field of Search ..... 148/327, 909, 442, 12 B, 148/14; 420/48, 59, 54, 56, 584; 428/586; 138/177

[56] References Cited

U.S. PATENT DOCUMENTS 4,400,349 8/1983 Kudo et al. ..... 420/584
4,560,408 12/1985 Wilhelmsson ..... 420/584

FOREIGN PATENT DOCUMENTS 62-14630 4/1987 Japan .
1190047 4/1970 United Kingdom ..... 420/584
2064583 6/1981 United Kingdom ..... 420/584

*Primary Examiner*—Deborah Yee
*Attorney, Agent, or Firm*—Lowe, Price, LeBlanc, Becker & Shur

[57] ABSTRACT

A low Si high-temperature strength steel tube with improved ductility and toughness which consists essentially of: not more than 0.10 wt % of carbon (C), not more than 0.15 wt % of silicon (Si), not more than 5 wt % of maganese (Mn), 20 to 30 wt % of cromium (Cr), 15 to 30 wt % of nickel (Ni), 0.15 to 0.35 wt % of nitrogen (N), 0.10 to 1.0 wt % of niobium (Nb) and not more than 0.005 wt % of oxygen ($O_2$); and at least one of 0.020 to 0.1 wt % of aluminum (Al) and 0.003 to 0.02 wt % of magnesium (Mg) in an amount defined by the following formula:

$$0.006\ (\%) \leqq 1/5Al(\%) + Mg(\%) \leqq 0.020\ \%$$

the balance being Fe and inevitable impurities.

8 Claims, 6 Drawing Sheets

Figure 1:
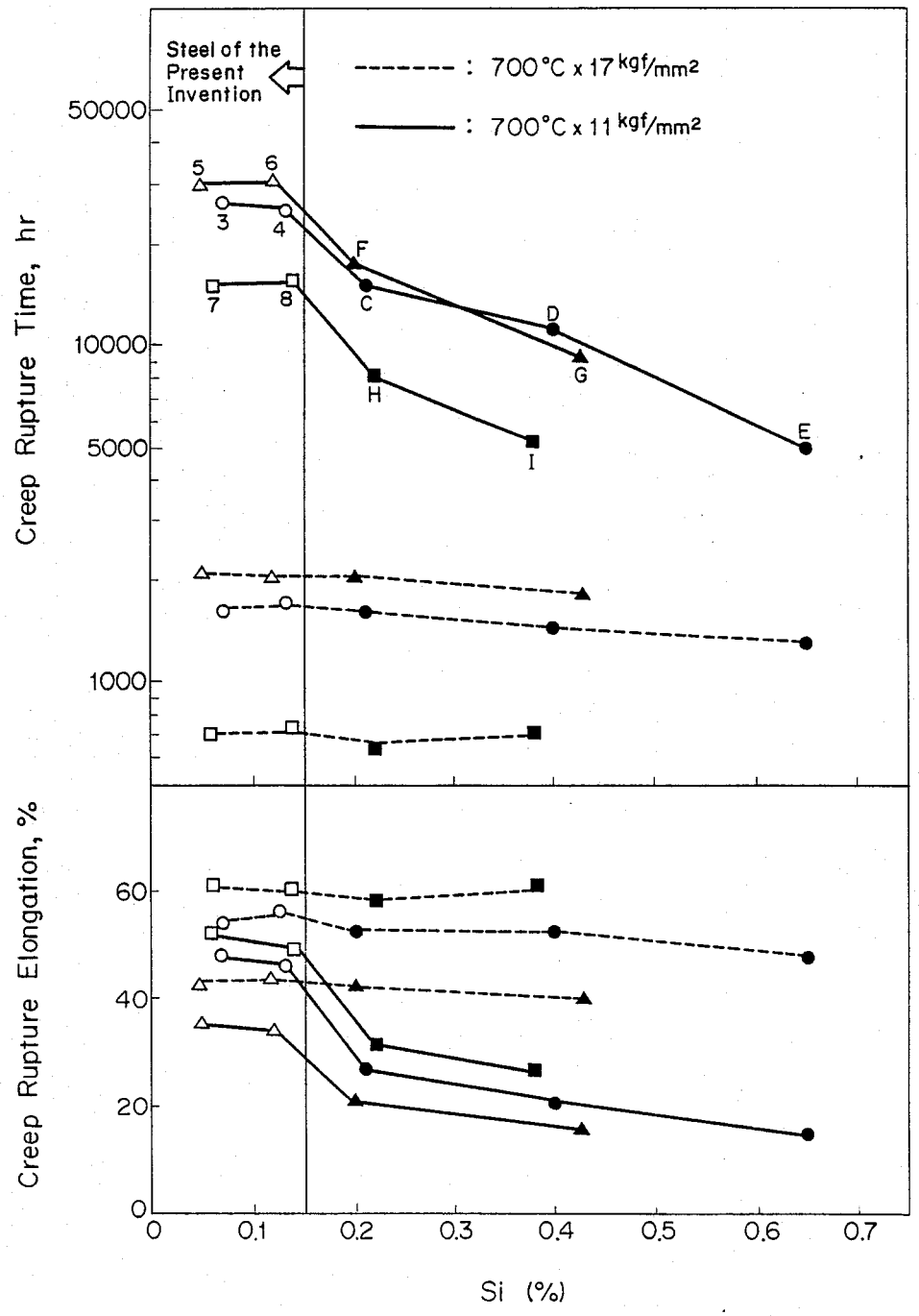

Relationship between Si Content and 700 °C Creep Rupture Time and Rupture Elongation Results of 700 °C x 11 kgf/mm² Creep Rupture Test Relationship between Si Content and Impact Value of 700°C x 3000hr-aged Material Impact Value of 700°C x 3000hr-aged Material and Residual Cr Amount and N Amount as Nitrides Produced by the Aging Relationship between Si Content and Residual Cr Amount, σ-phase Amount and N Amount as Nitrides Produced by 700°C x 3000hr Aging Relationship between Creep Rupture Life and Softening Treatment Temperature

| | | | | |
|---|---|---|---|---|
| Softening Temp., °C | 1100 | 1250 | 1100 | 1250 |
| Solution Temp., °C | 1200 | 1200 | 1200 | 1200 |
| Steel No. | 4 | | 5 | |

LOW SI HIGH-TEMPERATURE STRENGTH STEEL TUBE WITH IMPROVED DUCTILITY AND TOUGHNESS

FIELD OF THE INVENTION

This invention relates to a low Si high-temperature strength steel tube with improved ductility and toughness.

RELATED ARTS

Materials of a tube for a superheater or reheater, which is generally used under severe corrosive environment and high temperature such as in a coal fired power boiler or in an integrated coal gasification combined cycle plant, should have good ductility and toughness for a long term exposure under high temperature conditions as well as high-temperature strength and corrosion resistance.

In general, an improvement of corrosion resistance is attained by increasing a Cr content. However, if the amount of Cr is increased, an amount of Ni should also be increased to keep austenite phase. The resulting highly alloyed material can have improved corrosion resistance, but it does not have a high-temperature strength more than that of 18-8 stainless steel and, in most cases, it has a lowered high-temperature strength as in SUS310 steel.

In order to overcome these problems, the inventors previously proposed an austenite steel which is excellent both in weldability and in high-temperature strength in Japanese Patent Publication Kokoku No. 62-14630. This solution as disclosed in the publication is based on the following findings:

(1) Under the conditions that the amount of Cr is increased, N may be used for maintaining the austenite phase. The use of N can save the amount of Ni to be used and bring an effect of improving high-temperature strength by solid solution strengthening of N. When B and/or Nb is added alone or in combination, it will bring fine dispersion precipitation strengthening of carbonitrides, which will further improve the high-temperature strength.

(2) When Al and/or Mg is added, not only the high-temperature strength, but also the ductility and toughness will be increased.

(3) When the levels of contents of P and S as impurities are controlled to be low, subject to specific conditions, considering the amounts of B and Nb as well as the amounts of P and S, the weldability will be further improved.

SUMMARY OF THE INVENTION

Although the austenite steel as disclosed in the above-mentioned Japanese Patent Publication is somehow excellent in properties, it has also a disadvantage that Si, which has heretofore been considered to be contained in an amount of 0.3 wt% or more in the steel for the purpose of deoxidation, brings precipitation of massive nitrides ($Cr_2N$). The massive precipitate will lower the high-temperature strength, ductility and toughness after long term exposure. The content of Si in the steel is not lower than 0.16 wt% in Table 1 and Table 2 of the publication.

It is therefore an object of the present invention to provide a high-temperature steel tube having remarkably improved high-temperature strength, ductility and toughness.

DISCLOSURE OF THE INVENTION

The present invention features a low Si high-temperature strength steel tube with improved ductility and toughness which consists essentially of:

not more than 0.10 wt% of carbon (C), not more than 0.15 wt% of silicon (Si), not more than 5 wt% of manganese (Mn), 20 to 30 wt% of cromium (Cr), 15 to 30 wt% of nickel (Ni), 0.15 to 0.35 wt% of nitrogen (N), 0.10 to 1.0 wt% of niobium (Nb) and not more than 0.005 wt% of oxygen (O); and at least one of 0.020 to 0.1 wt% of aluminum (Al) and 0.003 to 0.02 wt% of magnesium (Mg) in an amount defined by the following formula:

$$0.006\ (\%) \leqq 1/5Al(\%) + Mg(\%) \leqq 0.020\% \quad (1)$$

the balance being Fe and inevitable impurities.

When B is further added in an amount of 0.001 to 0.020 wt%, the high-temperature strength will be further improved.

When a heat treatment is applied at a temperature which is 30° C. or more higher than a solution treatment temperature in the production process of the tube before the solution treatment, the high-temperature strength will be further improved.

The invention will now be described in detail.

The meanings of the numerical restriction in the present inventions will first be described.

C: C is a component effective for procuring tensile strength and creep rupture strength required for a high-temperature steel. However, in the present invention, the content of C is held down to 0.10 wt% or lower because N added is utilized to develop the strength and C will deteriorate grain boundary corrosion resistance when C is added in an amount more than 0.10 wt%.

N: N is an element which forms austenite with C and it is effective for improving high-temperature strength. 0.15 wt% or more of N is necessary to develop the effect sufficiently. However, when the content of N exceeds 0.35 wt%, a considerable amount of nitrides are produced and the toughness after aging will be lowered. By these reasons, the content of N is selected to be within a range from 0.15 to 0.35 wt%.

In this connection, it is to be noted that since the solubility limit of N is raised by decreasing the content of Si in the present invention, the precipitation of nitrides can be suppressed even in a high N-content range. Therefore, more preferably, the content of N is selected to be within a range of 0.20 to 0.35 wt% with a view to further improving high-temperature strength.

Si: Si is an element effective as a deoxidizer and, in general, it is essential to be contained about 0.3 wt% or more in an austenite stainless steel. However, N added will adversely accelerate precipitation of cromium nitride ($Cr_2N$) which is a cause for deterioration of ductility and toughness after a long term exposure and will also lower creep rupture strength after a long term exposure. In view of these facts, the content of Si is reduced to 0.15 wt% or lower to prevent the precipitation of cromium nitride ($Cr_2N$) and to acquire excellent performances.

Mn: Mn is effective for deoxidation and improvement of workability. Mn is also useful for austenite formation and can be substituted for some portion of Ni. However, if Mn is added in excess, it will accelerate precipitation of σ-phase, lowering the creep rupture strength, ductility and toughness after a long term exposure. By this reason, the content of Mn is selected to be 5 wt% or lower.

Cr: Cr shows remarkable effects for improvement of oxidation resistance and corrosion resistance. However, when the content is lower than 20 wt%, sufficient oxidation resistance can not be obtained and if the content exceeds 30 wt%, not only the workability is deteriorated to an unsatisfactory level, but also it becomes difficult to obtain stable, full austenite phase. By these reasons, the content of Cr is selected to be within a range of 20 to 30 wt%. With a view to having a sufficient anticorrosion in a severe corrosive environment, it is preferred that the content of Cr be 22 wt% or higher and with a view to suppressing the precipitation of nitrides, it is preferred that the content of Cr be 27 wt% or lower.

Ni: Ni is essential to obtain a stable austenite structure. The content of Ni is determined in relation with the N content and Cr content. In the present invention, 15 to 30 wt% of Ni is considered to be suitable.

When the content of N is selected to be within a range of 0.20 to 0.35 wt% with a view to improving the high-temperature strength, the content of Ni is preferably selected within a range of 15 to 25 wt% to suppress the precipitation of the nitrides.

Al, Mg: Al and Mg are elements which are not only effective for deoxidation and improvement of workability, but also operative for improvement of creep rupture strength or toughness. When the content of Si is considerably reduced as in the present steel, it is necessary, to develop the effects of Al and/or Mg, to add at least one of 0.020 wt% or more of Al and 0.003 wt% or more of Mg in the amounts as defined by formula (1). However, if the content of Al exceeds 0.1 wt%, it accelerates to precipitation of σ-phase and again lowers the strength and toughness after a long term exposure. By this reason, Al is contained in an amount of 0.020 to 0.10 wt%.

On the other hand, if the content of Mg exceeds 0.02 wt%, the effects for improving the workability, ductility and toughness are lowered and the weldability is also deteriorated. Therefore, the content of Mg is selected between 0.003 and 0.20 wt%.

O: As the content of O is increased, the creep rupture strength and rupture ductility is lowered. Therefore, it is necessary to hold down the content of O to 0.005 wt% or lower in the extremely low-Si content steel as of the present invention. A preferable upper limit of O is 0.003 wt%.

Nb: Nb is effective as an element for fine dispersion precipitation strengthening of carbide and nitrides. Especially in the N-added steel as of the present invention, a composite nitride such as NbCrN is finely precipitated to enhance the strength. To develop this effect, Nb is to be contained in an amount not less than 0.1 wt%. However, if Nb is added in excess, the amount of insolved Nb-carbon-nitride in the solution treatment condition is increased. By this reason, the range of 0.1 to 1.0 wt% is employed in the present invention. Especially, the content of Nb is preferred to be 0.20 to 0.60 wt% from a point of view of a balance between the creep rupture strength and the rupture ductility.

B: B is an element which is effective for improving the high-temperature strength due to the fine dispersion precipitation strengthening of carbides and grain boundary strengthening. However, the content of B is lower than 0.001 wt%, no effect can be obtained, but when B is contained in excess, the weldability is deteriorated. By these reasons, the upper limit of the content of B is selected to be 0.020 wt%. A preferable upper limit is 0.005 wt%.

P, S: P and S which are contained as impurities adversely affect the weldability and lower the creep rupture strength. By this reason, the contents of P and S are to be held down to 0.020 wt% or lower and 0.005 wt% or lower, respectively.

Heat treatment at a temperature 30° C. or more higher than a solution treatment:

In the producing process before the solution treatment, heat treatment is applied at a temperature higher by 30° C. or more than the temperature of the solution treatment. The producing process before the solution includes a hot process such as a working of a steel ingot into a billet and a hot extrusion, and a softening annealing before a cold working process. It will suffice to attain the intended purpose that the heating treatment as specified above is applied at least one of these steps. In the producing process of the conventional austenite steel tube, the heat treatment before the solution treatment is carried out at a temperature of 1200° C. or lower and never conducted at a temperature of solution treatment temperature +30° C. The softening annealing is conventionally carried out at a temperature lower than the solution treatment temperature.

In N and Nb added steel, some insolved nitrides remain insolved even after the solution treatment has been applied. These insolved nitrides are present in the form of massive block and do not contribute to the improvement of the high-temperature strength. To decrease the insolved nitrides, the solution treatment temperature may be raised, which, however, will form coarse crystal grains and lowers the ductility. By contrast, if the heating before the solution treatment is carried out at a temperature higher than the solution treatment temperature, the amount of insolved nitrides at the time of softening treatment will decrease. Although nitrides which is solved supersaturatedly at the time of the solution treatment after heating are precipitated again, the so precipitated nitrides are in the form of NbCrN which are very fine as compared with the insolved nitrides. More particularly, by applying a heat treatment at a temperature higher than the solution treatment temperature before the solution treatment, the amount of the fine NbCrN which contributes to strengthening is increased. Thus, the creep rupture strength is further increased. This effect will be prominent when the heat treatment is carried out at a temperature which is higher by 30° C. or more than the solution treatment temperature.

EXAMPLES

The invention will now be described, referring to examples.

Table 1 and Table 2 show chemical compositions of materials tested. (1) to (15) are steels of the present invention and (A) to (P) are steels for comparison. These steels were made into 17 kg ingot steel under vacuum, subjected to softening treatment at a temperature of 1100° C. after forging and further subjected to solution treatment at a temperature of 1200° C. after cold rolling. For some of the materials, the softening treatment was conducted at a raised temperature as high as 1250° C.

These materials were subjected to creep rupture test at a temperature of 700° C. and 700° C.×3000 hr-aged materials were subjected to Charpy impact test and determined about residual Cr amount and N amount in nitrides produced by the aging. An area percentage of σ-phase was also obtained. Hot corrosion test of the materials coated with synthetic ash in preparation for use in a coal-burning boiler was conducted. The results are summarized in Table 3.

Figure 2:
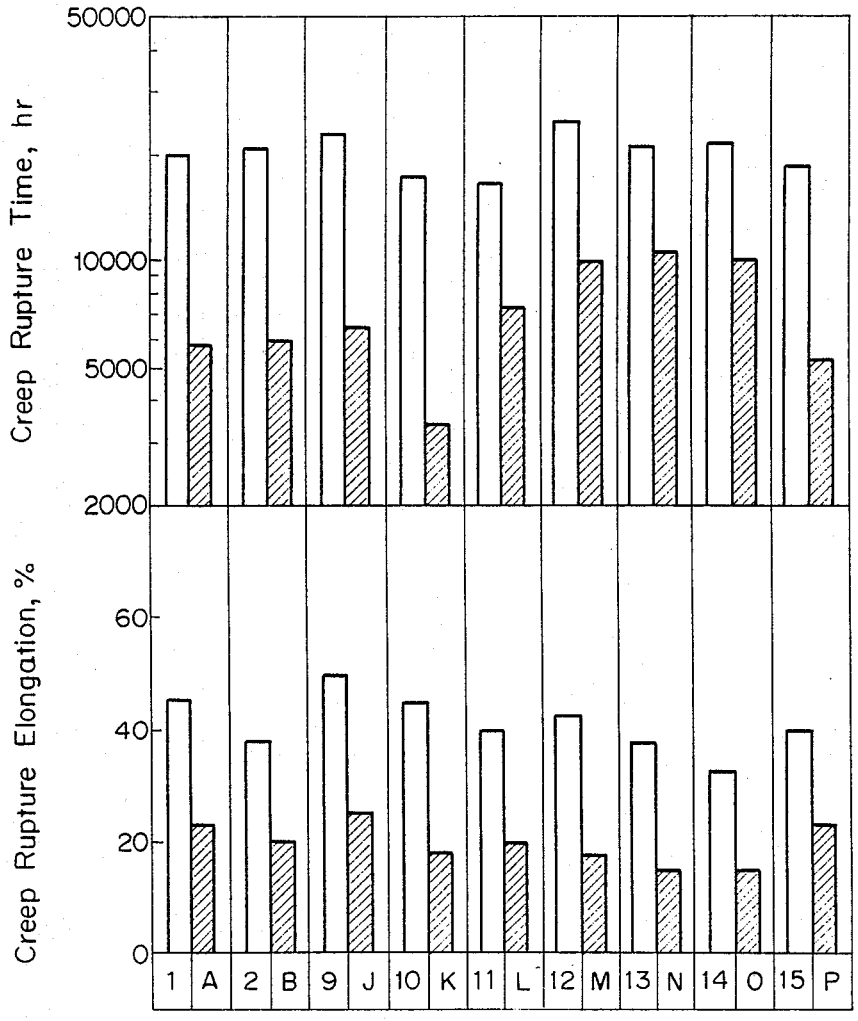
Figure 3:
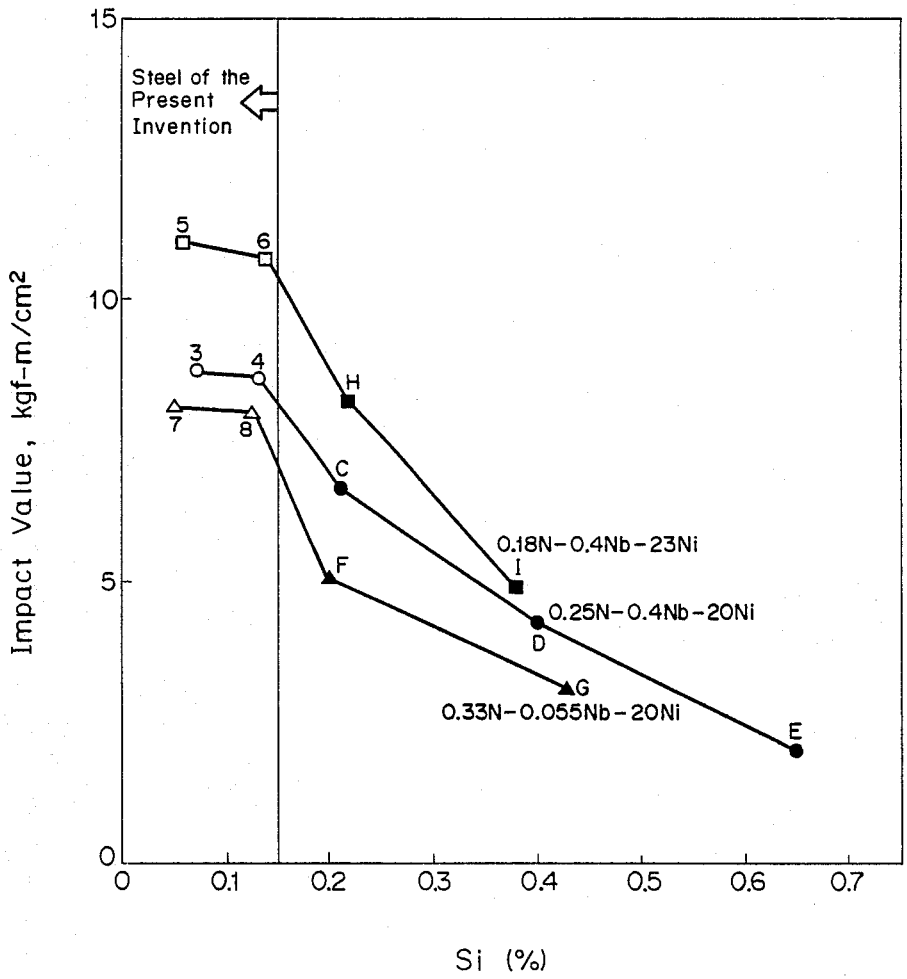
Figure 4:
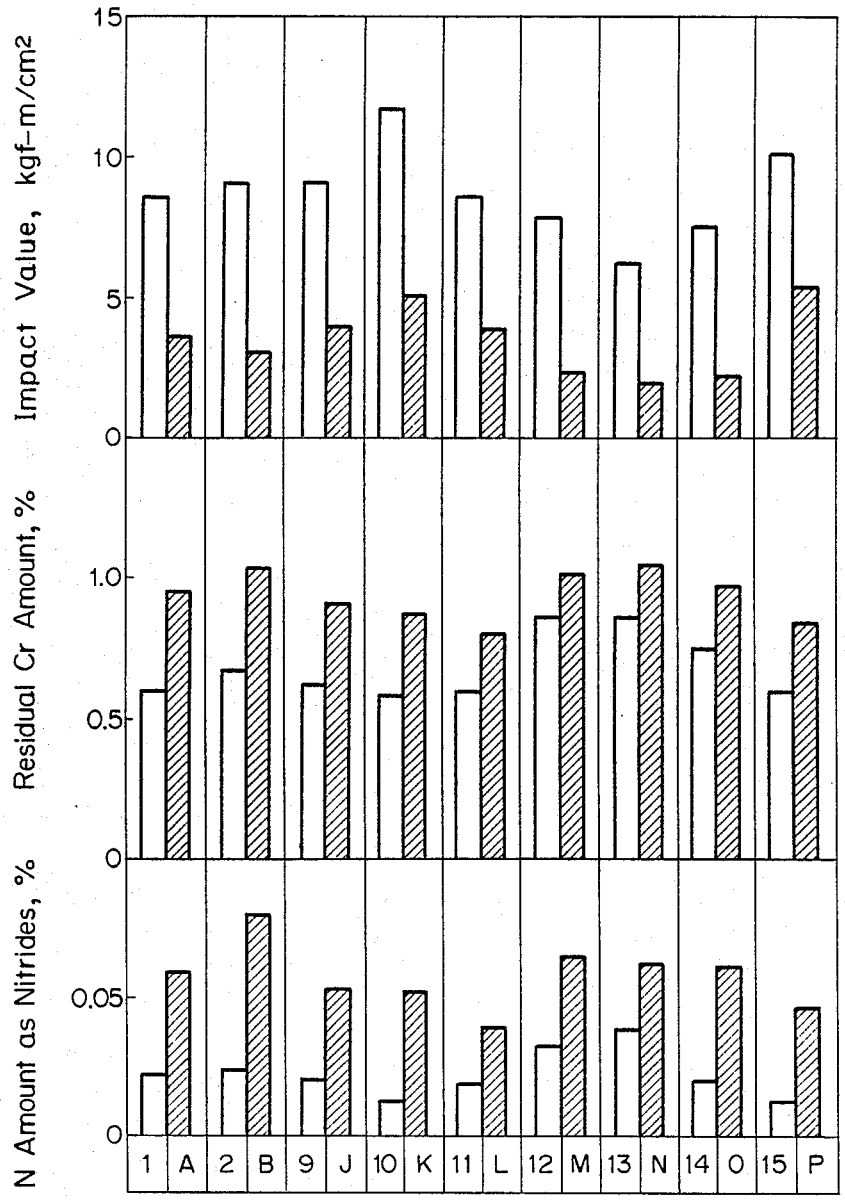
Figure 5:
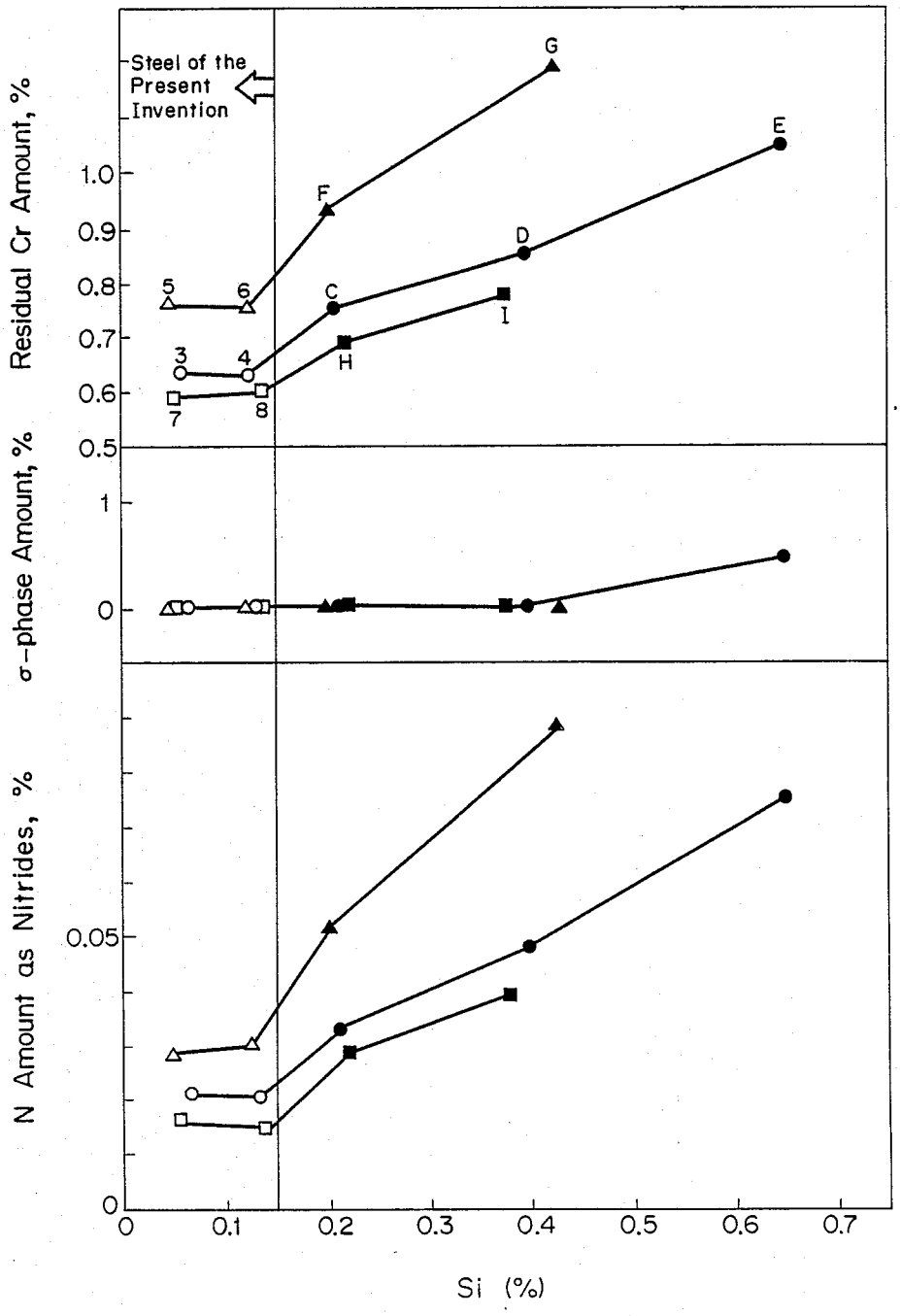
Figure 6:
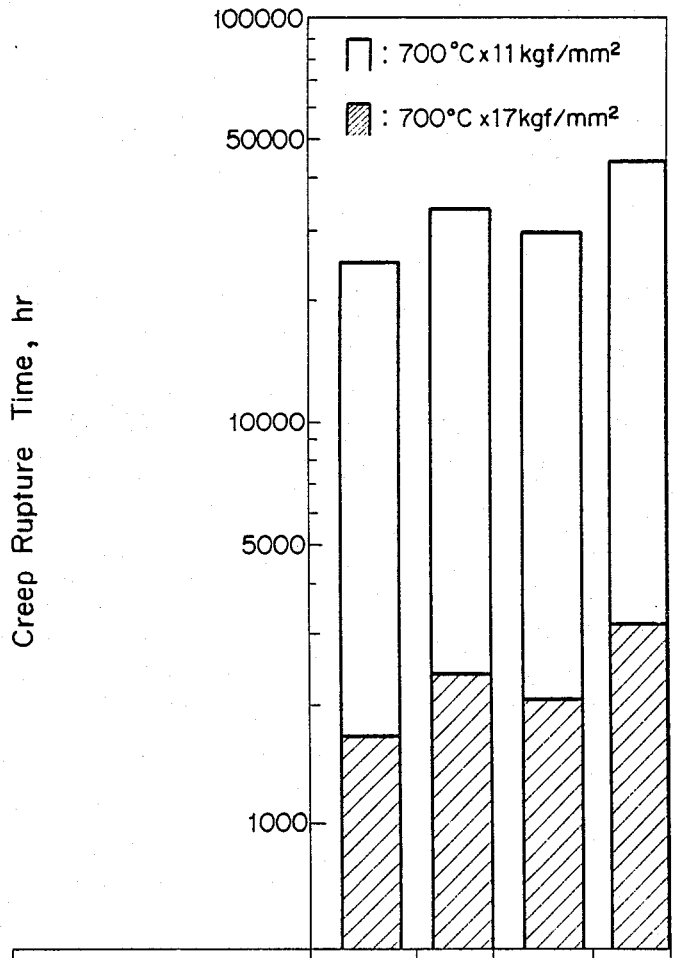

FIG. 1 shows a relationship between a Si content and 700° C. creep rupture time and rupture elongation, FIG. 2 shows results of creep rupture test conducted under conditions of 700° C.×11 kgf/mm², FIG. 3 shows a relationship between a Si content and impact value of 700° C.×3000 hr-aged materials, FIG. 4 shows Charpy impact values of 700° C.×3000 hr-aged materials and residual Cr amount and N amount in nitrides produced by the aging, FIG. 5 shows a relationship between a Si amount and residual Cr amount, σ-phase amount and N amount in nitrides produced by 700° C.×3000 hr aging, and FIG. 6 shows a relationship between creep rupture life and softening treatment temperature.

TABLE 1

| | Chemical Components of Materials under Tests (Steel of the Present Invention) | | | | | | | | | | |
|---|---|---|---|---|---|---|---|---|---|---|---|
| No. | C | Si | Mn | Cr | Ni | N | Al | Mg | Nb | B | $O_2$ |
| 1 | 0.060 | 0.05 | 0.70 | 25.15 | 20.16 | 0.245 | 0.026 | 0.010 | 0.44 | — | 0.0023 |
| 2 | 0.010 | 0.08 | 1.10 | 24.76 | 19.87 | 0.289 | 0.034 | — | 0.47 | — | 0.0020 |
| 3 | 0.061 | 0.07 | 1.03 | 24.86 | 20.14 | 0.256 | 0.045 | — | 0.40 | 0.0020 | 0.0014 |
| 4 | 0.062 | 0.13 | 1.00 | 25.02 | 20.10 | 0.260 | 0.048 | — | 0.41 | 0.0018 | 0.0015 |
| 5 | 0.068 | 0.05 | 1.05 | 24.95 | 19.94 | 0.331 | 0.026 | 0.005 | 0.55 | 0.0022 | 0.0022 |
| 6 | 0.073 | 0.12 | 1.00 | 24.98 | 20.03 | 0.326 | 0.028 | 0.005 | 0.53 | 0.0020 | 0.0029 |
| 7 | 0.058 | 0.06 | 0.75 | 25.14 | 23.42 | 0.178 | 0.039 | — | 0.39 | 0.0042 | 0.0015 |
| 8 | 0.060 | 0.14 | 0.80 | 25.00 | 23.61 | 0.180 | 0.037 | — | 0.40 | 0.0040 | 0.0025 |
| 9 | 0.008 | 0.10 | 1.03 | 24.84 | 20.16 | 0.250 | 0.038 | 0.006 | 0.45 | 0.0015 | 0.0025 |
| 10 | 0.051 | 0.08 | 1.10 | 20.76 | 15.46 | 0.157 | 0.053 | — | 0.12 | 0.0080 | 0.0020 |
| 11 | 0.063 | 0.10 | 1.06 | 22.58 | 17.52 | 0.210 | 0.067 | — | 0.25 | 0.0032 | 0.0018 |
| 12 | 0.065 | 0.13 | 1.00 | 28.85 | 27.76 | 0.249 | 0.033 | — | 0.40 | 0.0015 | 0.0010 |
| 13 | 0.070 | 0.08 | 0.97 | 24.96 | 18.05 | 0.260 | 0.053 | — | 0.89 | 0.0020 | 0.0025 |
| 14 | 0.063 | 0.11 | 3.80 | 25.86 | 20.91 | 0.240 | 0.031 | 0.007 | 0.45 | 0.0020 | 0.0020 |
| 15 | 0.092 | 0.09 | 1.11 | 25.00 | 22.86 | 0.158 | — | 0.012 | 0.29 | 0.0018 | 0.0023 |

TABLE 2

| | Chemical Components of Materials under Tests (Steel of the Present Invention) | | | | | | | | | | |
|---|---|---|---|---|---|---|---|---|---|---|---|
| No. | C | Si | Mn | Cr | Ni | N | Al | Mg | Nb | B | $O_2$ |
| A | 0.062 | 0.52 | 0.68 | 25.04 | 20.20 | 0.248 | 0.028 | 0.009 | 0.45 | — | 0.0025 |
| B | 0.011 | 0.48 | 1.15 | 24.88 | 20.05 | 0.291 | 0.030 | — | 0.47 | — | 0.0020 |
| C | 0.062 | 0.21 | 1.06 | 25.00 | 20.21 | 0.251 | 0.043 | — | 0.40 | 0.0021 | 0.0025 |
| D | 0.060 | 0.40 | 1.10 | 25.12 | 19.95 | 0.254 | 0.045 | — | 0.39 | 0.0019 | 0.0015 |
| E | 0.063 | 0.65 | 1.00 | 24.98 | 20.26 | 0.250 | 0.046 | — | 0.41 | 0.0020 | 0.0018 |
| F | 0.072 | 0.20 | 0.98 | 25.14 | 20.24 | 0.334 | 0.025 | 0.006 | 0.56 | 0.0025 | 0.0025 |
| G | 0.073 | 0.43 | 1.00 | 25.03 | 20.24 | 0.328 | 0.028 | 0.004 | 0.54 | 0.0024 | 0.0026 |
| H | 0.060 | 0.22 | 0.76 | 24.86 | 23.51 | 0.175 | 0.037 | — | 0.40 | 0.0046 | 0.0020 |
| I | 0.060 | 0.38 | 0.73 | 24.91 | 23.58 | 0.180 | 0.038 | — | 0.38 | 0.0043 | 0.0025 |
| J | 0.009 | 0.48 | 1.10 | 24.86 | 20.32 | 0.256 | 0.040 | 0.007 | 0.46 | 0.0018 | 0.0018 |
| K | 0.048 | 0.61 | 1.07 | 20.52 | 15.63 | 0.160 | 0.053 | — | 0.13 | 0.0078 | 0.0020 |
| L | 0.065 | 0.53 | 1.03 | 23.00 | 17.61 | 0.205 | 0.070 | — | 0.26 | 0.0036 | 0.0028 |
| M | 0.065 | 0.32 | 1.03 | 29.02 | 28.12 | 0.253 | 0.035 | — | 0.42 | 0.0013 | 0.0032 |
| N | 0.073 | 0.43 | 1.05 | 25.32 | 18.21 | 0.258 | 0.048 | — | 0.86 | 0.0023 | 0.0025 |
| O | 0.059 | 0.54 | 3.85 | 25.92 | 21.10 | 0.236 | 0.030 | 0.008 | 0.43 | 0.0021 | 0.0020 |
| P | 0.093 | 0.50 | 1.00 | 24.88 | 23.04 | 0.162 | — | 0.013 | 0.28 | 0.0020 | 0.0015 |

TABLE 3

| | Creep Rupture Test (700° C.) | | | | Impact Value of | Precipitated Amount by | | | Loss in Weight by |
|---|---|---|---|---|---|---|---|---|---|
| | 17 kgf/mm² | | 11 kgf/mm² | | 700° C. × 3000 h | 700° C. × 3000 h Aging | | | |
| | Rupture Time, h | Rupture Elongation, % | Rupture Time, h | Rupture Elongation, % | Aged Material, kgf-m/cm² | N (%) as Nitrides | Residual Cr (%) | σ-phase (%) | Hot Corrosion, mg/cm² |
| | | | | Results of Tests Steel of the Present Invention | | | | | |
| 1 | 1286 | 52 | 19327 | 46 | 8.5 | 0.0218 | 0.60 | 0 | 11.8 |
| 2 | 1311 | 46 | 20166 | 38 | 9.0 | 0.0236 | 0.67 | 0 | 11.9 |
| 3 | 1590 | 54 | 26513 | 48 | 8.7 | 0.0212 | 0.64 | 0 | 12.0 |
| 4 | 1682 | 56 | 25068 | 46 | 8.5 | 0.0203 | 0.63 | 0 | 11.8 |
| 5 | 2094 | 43 | 29778 | 35 | 8.1 | 0.0285 | 0.76 | 0 | 11.5 |
| 6 | 2038 | 44 | 30324 | 34 | 7.9 | 0.0294 | 0.75 | 0 | 11.7 |
| 7 | 693 | 61 | 14923 | 52 | 11.0 | 0.0160 | 0.59 | 0 | 12.0 |
| 8 | 727 | 60 | 15222 | 49 | 10.7 | 0.0142 | 0.60 | 0 | 12.0 |
| 9 | 1316 | 58 | 22497 | 50 | 9.0 | 0.0205 | 0.62 | 0 | 12.2 |
| 10 | 375 | 56 | 17220 | 45 | 11.5 | 0.0125 | 0.58 | 0 | 16.3 |
| 11 | 856 | 49 | 16728 | 40 | 8.5 | 0.0194 | 0.60 | 0 | 14.2 |
| 12 | 1568 | 50 | 24967 | 43 | 7.8 | 0.0332 | 0.86 | 0 | 10.3 |
| 13 | 1711 | 44 | 21058 | 38 | 6.0 | 0.0389 | 0.86 | 0 | 12.1 |
| 14 | 1635 | 53 | 21627 | 33 | 7.5 | 0.0205 | 0.75 | 0.023 | 11.8 |
| 15 | 401 | 48 | 18663 | 40 | 10.0 | 0.0131 | 0.60 | 0 | 12.2 |
| | | | | Results of Tests | | | | | |

TABLE 3-continued

| | Creep Rupture Test (700° C.) | | | | Impact Value of | Precipitated Amount by | | | |
|---|---|---|---|---|---|---|---|---|---|
| | 17 kgf/mm² | | 11 kgf/mm² | | 700° C. × 3000 h | 700° C. × 3000 h Aging | | | Loss in Weight by |
| | Rupture Time, h | Rupture Elongation, % | Rupture Time, h | Rupture Elongation, % | Aged Material, kgf-m/cm² | N (%) as Nitrides | Residual Cr (%) | σ-phase (%) | Hot Corrosion, mg/cm² |
| | | | | | (Steel for Comparison) | | | | |
| A | 1302 | 50 | 5634 | 23 | 3.5 | 0.0583 | 0.95 | 0 | 11.5 |
| B | 1385 | 48 | 5830 | 20 | 3.0 | 0.0795 | 1.03 | 0 | 12.1 |
| C | 1611 | 53 | 15112 | 27 | 6.6 | 0.0327 | 0.75 | 0 | 11.8 |
| D | 1468 | 53 | 11086 | 21 | 4.3 | 0.0478 | 0.84 | 0 | 12.0 |
| E | 1297 | 48 | 5075 | 15 | 2.0 | 0.0749 | 1.05 | 0.045 | 11.8 |
| F | 2075 | 42 | 17476 | 21 | 5.0 | 0.0514 | 0.93 | 0 | 11.7 |
| G | 1815 | 40 | 9287 | 16 | 3.1 | 0.0882 | 1.10 | 0 | 11.4 |
| H | 638 | 58 | 8035 | 31 | 8.2 | 0.0284 | 0.69 | 0 | 12.2 |
| I | 706 | 61 | 5233 | 27 | 4.9 | 0.0386 | 0.77 | 0 | 11.8 |
| J | 1357 | 56 | 6355 | 25 | 3.9 | 0.0536 | 0.90 | 0 | 12.0 |
| K | 352 | 53 | 3411 | 18 | 5.0 | 0.0518 | 0.87 | 0.027 | 16.6 |
| L | 903 | 51 | 7216 | 20 | 3.8 | 0.0400 | 0.80 | 0 | 14.3 |
| M | 1502 | 47 | 10036 | 18 | 2.3 | 0.0652 | 1.01 | 0 | 10.1 |
| N | 1804 | 44 | 10589 | 15 | 2.0 | 0.0633 | 1.05 | 0 | 12.1 |
| O | 1698 | 55 | 9977 | 15 | 2.2 | 0.0615 | 0.97 | 0.025 | 11.9 |
| P | 387 | 45 | 5218 | 23 | 5.3 | 0.0472 | 0.83 | 0 | 12.0 |

*High-temperature Corrosion Test Conditions
Ash Composition: $1.5^M Na_2SO_4$ - $1.5^M K_2SO_4$ - $1^M Fe_2O_3$
Gas Composition: 1% $SO_2$ - 5% $O_2$ - 15% $CO_2$ - bal $N_2$
Test Temperature, Time: 650° C. × 20 h

TABLE 4

Relationship between Creep Rupture Life and Softening Treatment Temperature

| Steel No. | Softening Treatment Temp., °C. | Solution Treatment Temp., °C. | Creep Rupture Time at 700° C., h 17 kgf/mm² | 11 kgf/mm² |
|---|---|---|---|---|
| 4 | 1100 | 1200 | 1682 | 25068 |
| | 1250 | 1200 | 2407 | 33970 |
| 5 | 1100 | 1200 | 2094 | 29778 |
| | 1250 | 1200 | 3186 | 43885 |

CONSIDERATION

As to creep rupture properties, as can be seen from Table 3 and FIGS. 1 and 2, there is little difference in creep rupture life and rupture elongation by a difference in Si amounts under relatively short time and high stress (17 kgf/mm²) conditions, whereas the amounts of Si have large influences under long time and low stress (11 kgf/mm²) conditions. When Si amount exceeds 0.15 wt%, both the creep rupture life and rupture elongation are remarkably lowered. From this, it can be seen that when the Si content is reduced as much as possible, the creep rupture life and rupture elongation are improved very much.

When the Si content is reduced, not only the creep rupture properties, but also impact properties after aging are improved very much as can be seen from FIGS. 3 and 4.

FIG. 5 shows residual Cr amount, σ-phase amount and N amount in nitrides produced by 700° C.×3000 hr aging with Si contents varied with some composition system steels. σ-phase, which will cause deterioration of creep rupture life, rupture elongation and toughness, is not found in any steel except Steel E for comparison. By contrast, the steels of the present invention largely differ from the steels for comparison in residual Cr amounts and N amounts in nitrides. In the steels of the present invention, the said amounts are lower as compared with the corresponding amounts of the steels for comparison and there is little massive $Cr_2N$ nitrides precipitation which will cause deterioration of performances. This tendency is also observed with other composition system steels as shown in FIG. 4. In the present invention which have low contents of Si held down to below 0.15 wt%, as different from conventional steel in which Si is commonly used in an amount of about 0.5 wt% as a deoxidizer and employ Al and/or Mg as a deoxidizer instead of Si, the steels can have sufficiently improved high-temperature strength, ductility and toughness required for materials to be used in high-temperature apparatus.

Furthermore, it has been confirmed that there is observed no tendency of deterioration of hot corrosion resistance by lowering Si content as can be seen from Table 3.

Further as shown in Table 4 and FIG. 6, the creep rupture strength is further improved both under short time (high stress) and long time (low stress) conditions by raising the softening treatment temperature higher than the solution treatment temperature.

As described above, the steels of the present invention show excellent creep rupture strength, breaking ductility, impact properties and corrosion resistance for high-temperature, long term exposure. Thus, the steels of the present invention is especially suited for use as materials of superheater tubes, reheater tubes which are subject to high-temperature, corrosive environment such as coal fired power boilers or integrated coal gasification combined cycle plants.

I claim:

1. A low Si high-temperature strength steel tube with improved ductility and toughness which consists essentially of:

not more than 0.10 wt% of carbon (C), not more than 0.15 wt% of silicon (Si), not more than 5 wt% of manganese (Mn), 22 to 27 wt% of chromium (Cr), 15 to 25 wt% of nickel (Ni), 0.2 to 0.35 wt% of nitrogen (N), 0.10 to 1.0 wt% of niobium (Nb) and not more than 0.005 wt% of oxygen ($O_2$); and at least one of 0.020 to 0.1 wt% of aluminum (Al) and 0.003 to 0.02 wt% of magnesium (Mg) in an amount defined by the following formula:

$0.006(\%) \leqq (1/5Al+Mg) \leqq 0.020(\%)$ the balance being Fe and inevitable impurities.

2. A low Si high-temperature strength steel tube with improved ductility and toughness which consists essentially of:

not more than 0.10 wt% of carbon (C), not more than 0.15 wt% of silicon (Si), not more than 5 wt% of manganese (Mn), 22 to 27 wt% of chromium (Cr), 15 to 25 wt% of nickel (Ni), 0.2 to 0.35 wt% of nitrogen (N), 0.10 to 1.0 wt% of niobium (Nb), not more than 0.005 wt% of oxygen ($O_2$) and 0.001 to 0.020 wt% of boron (B); and at least one of 0.020 to 0.1 wt% of aluminum (Al) and 0.003 to 0.02 wt% of magnesium (Mg) in an amount defined by the following formula:

$0.006(\%) \leqq (1/5Al+Mg) \leqq 0.020(\%)$ the balance being Fe and inevitable impurities.

3. A low Si high-temperature strength steel tube with improved ductility and toughness which consists essentially of:

not more than 0.10 wt% of carbon (C), not more than 0.15 wt% of silicon (Si), not more than 5 wt% of manganese (Mn), 20 to 30 wt% of chromium (Cr), 15 to 30 wt% of nickel (Ni), 0.15 to 0.35 wt% of nitrogen (N), 0.10 to 1.0 wt% of niobium (Nb) and not more than 0.005 wt% of oxygen ($O_2$); and at least one of 0.020 to 0.1 wt% of aluminum (Al) and 0.003 to 0.02 wt% of magnesium (Mg) in an amount defined by the following formula:

$0.006(\%) \leqq (1/5Al+Mg) \leqq 0.020(\%)$ the balance being Fe and inevitable impurities, said steel tube having been subjected to a heat treatment at a temperature which is about 30° C. or more higher than a solution treatment temperature during a production process of the tube before the solution treatment.

4. A low Si high-temperature strength steel tube with improved ductility and toughness which consists essentially of:

not more than 0.10 wt% of carbon (C), not more than 0.15 wt% of silicon (Si), not more than 5 wt% of manganese (Mn), 20 to 30 wt% of chromium (Cr), 15 to 30 wt% of nickel (Ni), 0.15 to 0.35 wt% of nitrogen (N), 0.10 to 1.0 wt% of niobium (Nb), not more than 0.005 wt% of oxygen ($O_2$) and 0.001 to 0.020 wt% of boron (B); and at least one of 0.020 to 0.1 wt% of aluminum (Al) and 0.003 to 0.02 wt% of magnesium (Mg) in an amount defined by the following formula:

$0.006(\%) \leqq (1/5Al+Mg) \leqq 0.020(\%)$ the balance being Fe and inevitable impurities, said steel tube having been subjected to a heat treatment at a temperature which is about 30° C. or more higher than a solution treatment temperatue during a production process of the tube before the solution treatment.

5. A low Si high-temperature strength steel tube with improved ductility and toughness as claimed in claim 1, in which Nb is contained in an amount of 0.2 to 0.6 wt% and B is contained in an amount of 0.001 to 0.005 wt%.

6. A low Si high-temperature strength steel tube with improved ductility and toughness as claimed in claim 2, in which Nb is contained in an amount of 0.2 to 0.6 wt% and B is contained in an amount of 0.001 to 0.005 wt%.

7. A low Si high-temperature strength steel tube with improved ductility and toughness which consists essentially of:

not more than 0.10 wt% of carbon (C), not more than 0.15 wt% of silicon (Si), not more than 5 wt% of manganese (Mn), 20 to 30 wt% of chromium (Cr), 15 to 30 wt% of nickel (Ni), 0.15 to 0.35 wt% of nitrogen (N), 0.10 to 1.0 wt% of niobium (Nb) and not more than 0.005 wt% of oxygen ($O_2$); and at least one of 0.020 to 0.1 wt% of aluminum (Al) and 0.003 to 0.02 wt% of magnesium (Mg) in an amount defined by the following formula:

$0.006(\%) \leqq (1/5Al+Mg) \leqq 0.020(\%)$ the balance being Fe and inevitable impurities.

8. A low Si high-temperature strength steel tube with improved ductility and toughness which consists essentially of:

not more than 0.10 wt% of carbon (C), not more than 0.15 wt% of silicon (Si), not more than 5 wt% of manganese (Mn), 20 to 30 wt% of chromium (Cr), 15 to 30 wt% of nickel (Ni), 0.15 to 0.35 wt% of nitrogen (N), 0.10 to 1.0 wt% of niobium (Nb), not more than 0.005 wt% of oxygen ($O_2$) and 0.001 to 0.020 wt% of boron (B); and at least one of 0.020 to 0.1 wt% of aluminum (Al) and 0.003 to 0.02 wt% of magnesium (Mg) in an amount defined by the following formula:

$0.006(\%) \leqq (1/5Al+Mg) \leqq 0.020(\%)$ the balance being Fe and inevitable impurities.

* * * * *